US006938780B2

(12) United States Patent
Baglione et al.

(10) Patent No.: US 6,938,780 B2
(45) Date of Patent: Sep. 6, 2005

(54) CENTRIFUGAL SEPARATOR IN PARTICULAR FOR FLUIDIZED BED REACTOR DEVICE

(75) Inventors: Daniel Baglione, Gentilly (FR); Jean-Claude Semedard, Paris (FR); Pierre Gauville, Verrieres (FR); Jean-Xavier Morin, Neuville aux Bois (FR); Emmanuel Flores, Le Plessis Robinson (FR)

(73) Assignee: Alstom (Switzerland) Ltd., Baden (CH)

( * ) Notice: Subject to any disclaimer, the term of this patent is extended or adjusted under 35 U.S.C. 154(b) by 72 days.

(21) Appl. No.: 10/451,769

(22) PCT Filed: Oct. 29, 2002

(86) PCT No.: PCT/EP02/12065

§ 371 (c)(1),
(2), (4) Date: Jun. 24, 2003

(87) PCT Pub. No.: WO03/037524

PCT Pub. Date: May 8, 2003

(65) Prior Publication Data

US 2004/0074814 A1 Apr. 22, 2004

(30) Foreign Application Priority Data

Oct. 30, 2001 (EP) ..... 01402809

(51) Int. Cl.[7] ..... B04C 5/04; F27B 15/00

(52) U.S. Cl. ..... 209/717; 209/719; 55/459.5; 422/147

(58) Field of Search ..... 209/717, 719, 209/134–139.1, 142, 143, 710, 711, 722; 55/459.4, 459.5; 422/145, 147

(56) References Cited

U.S. PATENT DOCUMENTS 5,771,844 A 6/1998 Dietz

FOREIGN PATENT DOCUMENTS

| | | |
|---|---|---|
| EP | 0 730 910 A2 | 9/1996 |
| EP | 0 763 384 A1 | 3/1997 |
| EP | 0763384 | 3/1997 |
| WO | WO 01/7622 A1 | 10/2001 |

*Primary Examiner*—Donald P. Walsh
*Assistant Examiner*—Joseph Rodriguez
(74) *Attorney, Agent, or Firm*—Cohen, Pontani, Lieberman & Pavane

(57) ABSTRACT

A centrifugal separator for separating particles from gas uses a separator chamber having an upper potion with at least three substantially vertical planar walls with perpendicular inner faces, and a lower portion, for defining in the chamber a vertical gas vortex. The gas vortex has an inlet formed in the vicinity of a first corner between the first and second walls for gas to be dedusted, an outlet for dedusted gas, and an outlet for separated particles. The separator uses an acceleration duct with a first transverse section at the first end of the duct that is distinctly greater than a second cross section at the second end. This second end is connected to the inlet for gas to be dedusted at the first corner.

31 Claims, 7 Drawing Sheets

CENTRIFUGAL SEPARATOR IN PARTICULAR FOR FLUIDIZED BED REACTOR DEVICE

PRIORITY CLAIM

This is a U.S. national stage of application No. PCT/EP02/12065, filed on Oct. 29, 2002. Priority is claimed on that application and on the following applicatin: Country: EPO, Application No.: 01 402 809.6, Filed: Oct. 30, 2001.

BACKGROUND OF THE INVENTION

1. Field of the Invention

The present invention relates to a centrifugal separator for separating particles from gas, comprising a separator chamber that comprises an upper portion delimited horizontally by walls and a lower portion having a downwardly decreasing horizontal cross section, the separator having means for defining therein a vertical gas vortex that comprise an inlet for gas to be dedusted formed in the upper portion of the chamber, an outlet for dedusted gas formed in said upper portion, and an outlet for separated particles formed in the lower portion of the chamber, said walls of the upper portion comprising at least a first, a second and a third substantially vertical planar walls, located one next to the other in the direction of flow of said gas vortex and defining three substantially vertical planar inner faces of said upper portion, said inlet for gas to be dedusted being formed in the vicinity of a first corner defined between said first and second walls, the inner faces of the first and second walls being substantially perpendicular and the inner faces of the second and third walls being substantially perpendicular.

The invention more specifically relates to a centrifugal separator for a circulating fluidized bed reactor device comprising a reactor chamber, a centrifugal separator and a back pass for heat recovery, the reactor device comprising means for introducing a fluidizing gas into the reactor chamber and for maintaining a fluidized bed of particles in said chamber.

2. Discussion of Related Art

In general, a reactor device is a boiler device where fuel particles (to which sorbent particles are suitably added for sulfur capture) are burnt in the reactor chamber, also named furnace or combustion chamber, and where heat generated is recover in the back pass, also named pass boiler, so as to produce energy (e.g. for driving electricity production turbines).

In such a reactor device, the gas to be dedusted—that contains particles—is transferred from the reactor chamber into the separator where the gas is dedusted. The separated particles are discharged from the separator and can be re-introduced, directly or indirectly, into the reactor chamber, also named combustion chamber. The dedusted gas is transferred from the separator into the back pass where heat of the gas is recovered by heat recovery areas located in the back pass.

The centrifugal separator being applied to a circulating fluidized bed reactor, this separator has to endure very high temperatures, the mixture of gas and particles entering the separator having a temperature of about 850° C., and the particles have an abrasive effect on the separator walls. The particles loading can be up to 20 kg/m$^3$.

Therefore, it is necessary for these walls to have a strong structure that can resist high temperatures and abrasion.

In conventional separators, the separator chamber has a cylindrical shape with a circular cross section.

Such a shape offers a good separation capacity since it corresponds to the outer envelop of the vortex flow created in the chamber so that counter effects such as turbulences that could affect the separation efficiency are substantially avoided.

However, the cylindrical walls of such conventional separators are expensive to manufacture. This drawback is even more disadvantageous when, as explained above, the walls must be heat and abrasion resistant.

A separator having the upper portion of its chamber provided with planar walls is disclosed in EP-B-0 730 910. This separator has the cross section of its interior gas space defined by these planar walls in the shape of a polygon such as a rectangle or a square.

Such a separator is easier to manufacture and to assemble than the above described conventional ones.

However, an interior gas space having the shape of a polygon such as a rectangle or a square as shown in EP-B-0 730 910 offers quite a poor separation efficiency because the vortex flow generated therein cannot follow such a shape.

A solution for improving the separation efficiency may consist in providing several separators operating in parallel or in series. However, this solution is expensive and cumbersome.

OBJECTS AND SUMMARY OF THE INVENTION

An object of the present invention is to provide a centrifugal separator substantially overcoming these drawbacks, while having a simple construction, offering a high separation efficiency and being compact.

This object is achieved with the separator according to the invention by the fact that it comprises an acceleration duct for accelerating a mixture of gas and particles circulating in said duct, from a first end to a second end thereof, before said mixture enters said separator chamber, a first transverse section of said acceleration duct at said first end thereof being distinctly greater than a second transverse section of said acceleration duct at said second end thereof, the fact that the second end of the acceleration duct is connected to said inlet for gas to be dedusted at the first corner, while forming an obtuse angle with said second wall, and the fact that said second end of the acceleration duct is inclined downwardly in a direction towards the separator chamber.

The first transverse section is measured perpendicularly to the flow direction of the mixture of gas and particles at the first end of the acceleration duct and the second transverse section is measured perpendicularly to the flow direction of the mixture of gas and particles at the second end of this duct.

The provision of the acceleration duct of the invention in a separator having at least some of its walls that are substantially planar walls, perpendicular one to the other, enables this separator to reach a separation efficiency that is of the same order as the efficiency of a conventional separator having a cylindrical shape with rounded cross section. Nevertheless, the separator of the invention is less expensive and easier to manufacture and to assemble that such a conventional separator.

Firstly, thanks to the acceleration duct, the mixture of gas and particles enters the separator chamber at high speeds, so that the centrifugal forces that cause separation are increased.

Secondly, the downward inclination of the acceleration duct, at its connection with the separator chamber, enables the flow of gas and particles to have a downwardly oriented component, so that the particles contained in this flow fall more easily towards the particles outlets without being re-circulated upwardly in the vortex generated in the separator chamber. When the downward component of the tangential speed of the outer circulation of the vortex is increased, then the tendency of the particles to be re-circulated upwardly is minimized.

A vortex has an outer circulation that flows downwardly and an inner circulation that flows upwardly.

The connection of the acceleration duct to the separator chamber is located at the first corner, that is far from the second corner. When the flow carried by the outer circulation of the vortex reaches this second corner, it has already been deflected downwardly by the vortex, which means that the flow reaches the second corner at a horizontal level that is below the horizontal level of inlet for gas to be dedusted. The bigger this difference of level (which increases with the distance between the inlet for gas to be dedusted and the second corner), the better the separation efficiency.

The acceleration duct is oriented with respect to the separator chamber so as to present a more or less tangential flow direction with respect to the vortex flow generated in the separator chamber. This orientation enables the vortex to be generated with its correct curvature at the inlet of the chamber. Also, such the obtuse angle between the second end of the duct and the second wall of the separator chamber avoids that particles separated from gas in the duct be accumulated at the connection between said duct and said chamber.

Advantageously, the second end of the acceleration duct is connected to the first wall of the separator chamber, at the first corner of this chamber, while forming an angle of at least 120° with the second wall of this chamber.

Advantageously, the second end of the acceleration duct is inclined downwardly in a direction of flow of said mixture of gas and particles at said second end.

This downward inclination in the direction of flow gives the flow the downwardly oriented component referred to above.

Advantageously, this second end is also inclined downwardly in the direction towards the second wall of the separator chamber, in a transverse cross section substantially perpendicular to a direction of flow of said mixture of gas and particles at said second end.

As will be explained herein-after, this inclination enables particles collected at the outer side of the acceleration duct while the mixture of gas and particles circulates in this duct to be introduced into the separator chamber while being hardly re-circulated in the gas.

Advantageously, the acceleration duct has wall portions that, at least at the second end of said duct, include a bottom wall portion that is inclined downwardly in a direction going towards the separator chamber.

These wall portions advantageously comprise a wall portion of the extrados disposed on the outer side of the acceleration duct, and the said bottom wall portion is inclined downwardly in a direction towards said wall portion of the extrados.

Advantageously, the first transverse section of the acceleration duct at its first end is 1.3 to 2.2 times bigger than the second transverse section of said acceleration duct at its second end.

Such relations between the first and second transverse sections provide for a significant acceleration of the mixture of gas and particles within the acceleration duct.

According to another advantageous feature of the invention, the separator comprises deflection wall means disposed at a second corner that is formed between said second and third walls so as to form a non perpendicular transition between the inner faces of said second and third walls.

The deflection wall means are disposed in the second corner, that is in this corner of the interior gas space of the chamber that is affected first by the flow of the mixture of particles and gas after said mixture has entered the separator chamber. The deflection wall means deflect the flow at this corner, so that this flow takes up the required curvature for passing from the second wall to the third wall without any significant counter-flow such as turbulences being generated in this corner.

The applicant has established that this second corner of the chamber, which is affected first by the flow, once the latter has over passed the separator inlet, is essential as to the separation efficiency. Thanks to the deflection wall means, the flow takes up its correct curvature in the chamber so that, not only turbulences are substantially avoided at the second corner, but also turbulences are limited at the other corners of the chamber.

A vortex has an outer circulation that flows downwardly and an inner circulation that flows upwardly. As a consequence, should a counter flow tending to re-circulate particles in the gas to be generated in a region of the chamber affected by the flow after the said second corner, then this region would be affected at a lower horizontal level compared to the horizontal level at which said second corner is affected first by the flow. Consequently, should particles be re-circulated in the flow in this region, then it would be more difficult for these particles to be carried upwardly to a sufficient extent for them to escape the separator chamber via the outlet for the dedusted gas.

The deflection wall means can be part of the outer walls of the separator chamber, establishing the connection between the second and the third walls thereof.

The deflection wall means can also be composed of one or several inner wall elements that are disposed inside the separator chamber, in the corner between the second and third walls of said chamber that join together at said corner.

The deflection wall means may advantageously comprise a deflection wall member having a substantially planar inner face that forms with the second wall an angle substantially equal to the angle formed between the inlet duct and said second wall.

In a variant embodiment, the deflection wall means comprise a deflection wall member having a concave inner face.

In an advantageous embodiment the deflection wall means, the upper portion of the separator chamber is delimited by four substantially vertical planar walls, the inner faces of which delimiting a horizontal cross section that defers from a rectangular cross section in that the deflection wall means are disposed in said second corner.

In this advantageous embodiment, the separator chamber has a very simple shape, that is easy to manufacture and advantageous as far as costs are concerned. The quasi-rectangular cross section as defined above is particularly advantageous when, as described in the detailed description, the separator chamber has a water wall structure.

In a first advantageous variant as to the lower portion of the separator chamber; this lower portion has the form of a pyramid having downwardly converging walls.

This pyramid shape offers the advantage of preserving the symmetry in the vortex flow with respect to its vertical axis, even in the lower portion of the separator chamber.

In a second advantageous variant, the upper portion of the separator chamber has a fourth substantially vertical planar wall arranged between said first and third walls thereof and the lower portion of said chamber comprises four walls among which a first, a third and a fourth substantially vertical planar walls extend vertically as respective downward extensions of said first, third and fourth walls of the upper portion, whereas the second wall of this lower portion is a substantially planar wall, that extends under said second substantially vertical planar wall of the upper portion and that is inclined towards said fourth substantially vertical planar wall of the lower portion.

This second advantageous variant has a very simple construction and is very easy to manufacture.

The separator of the invention is particularly aimed for being implemented in a circulating fluidized bed reactor device because of its compact structure, its ability to endure elevated temperatures and its high separation efficiency. Thereby, the reactor device comprises means for transferring gas to be dedusted from the reactor chamber into the separator via the acceleration duct, means for discharging separated particles form the separator via the outlet for separated particles and means for transferring dedusted gas from the separator into the back pass via the outlet for dedusted gas.

An acceleration duct 24 between the reactor chamber and the separator significantly improves the separator efficiency and allows to increase the residence time in the reactor loop of the fuel to be burnt and of the sorbent introduced for sulphur capture. Indeed, an increased residence time decreases the average size of the particles to be separated, which is beneficial for heat transfer.

Advantageously, the acceleration duct extends from a side wall of the reactor chamber to said first wall of the upper portion of the separator.

Thus, the acceleration duct does not significantly add to the overall bulkiness of the reactor device since it is located in a recess formed by the angle between the side wall of the reactor chamber and the first wall of the upper portion of the reactor chamber.

Advantageously, the upper portion of the separator has a fourth substantially vertical planar wall arranged between said first and third walls thereof, and this fourth wall is a common wall between the separator and the back pass.

Still advantageously, the first wall of the upper portion of the separator is parallel to a common wall between the back pass and the reactor chamber, which is a front wall of the back pass and a rear wall of the reactor chamber, whereas said chamber has a side wall that is parallel to the fourth wall of the upper portion of the separator and that is possibly aligned with said fourth wall.

BRIEF DESCRIPTION OF THE DRAWINGS

The invention will be well understood and its advantages will appear more clearly on reading the following detailed description of embodiments shown by way of non limiting examples. The description is given with reference to the accompanying drawings, in which.

DETAILED DESCRIPTION OF THE PRESENTLY PREFERRED EMBODIMENTS

Figure 1:
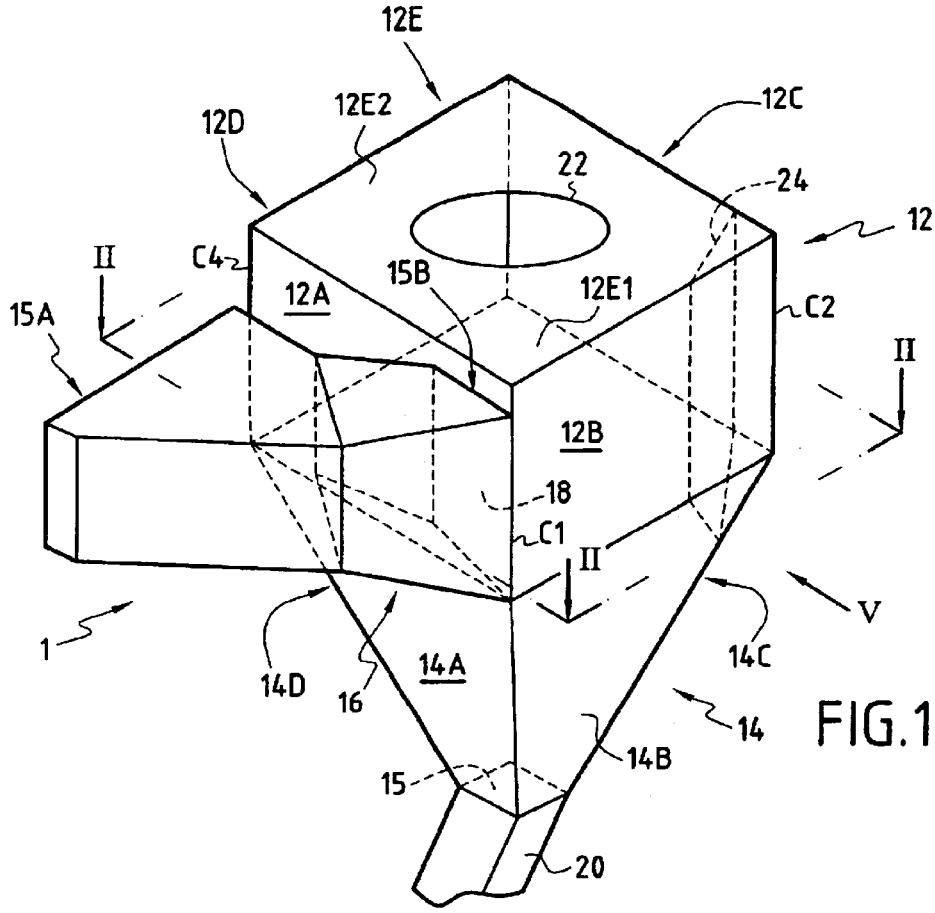
FIG. 1 is a perspective view of a separator according to a first embodiment of the invention.

FIG. 1 shows a centrifugal separator 1 having a separator chamber 10 that comprises an upper portion 12 and a lower portion 14.

The upper portion 12 is delimited horizontally by walls including a first wall 12A, a second wall 12B, third wall 12C and a fourth wall 12D that are vertical planar walls. In the separator of the invention, at least the first three walls 12A, 12B and 12C are substantially vertical planar walls.

The upper portion 12 of chamber 10 has a substantially constant horizontal cross section throughout its height.

An acceleration duct 16 is connected to an inlet 18 for gas to be dedusted so as to convey a mixture of gas and particles into the upper portion 12 of the chamber.

Inlet 18 is formed in the first wall 12A, in the vicinity of a corner C1 that this first wall forms with the second wall 12B.

The lower portion 14 of chamber 10 has a hopper-like form, with a horizontal cross-section that decreases in the downward direction.

This lower portion has four walls, 14A, 14B, 14C and 14D, that respectively extend under the walls 12A, 12B, 12C and 12D of the upper portion. These four walls 14A, 14B, 14C and 14D are inclined with respect to the vertical direction so that the lower portion 14 of the separator chamber has the form of a pyramid having downwardly converging walls (that is: the apex of the pyramid is orientated downwards). For example, the walls of the pyramid are inclined of 45° to 80°, suitably of about 70°, with respect to the horizontal direction.

At their lower edges, the walls 14A, 14B, 14C and 14D delimit a rectangular (preferably square) opening 15, to which is connected an outlet duct 20, thus forming an outlet for the particles separated from gas.

At its upper end, the chamber 10 has an outlet for dedusted gas. More precisely, an opening 22 is formed in the roof 12E of the upper portion 12 of the chamber, in a central region of this roof, which can be substantially vertically aligned with opening 15 or offset with respect thereto, towards wall 12D and/or wall 12A.

Means (not shown) for generating a flue gas depression above opening 22 (which, as will be described hereinafter, advantageously opens into a flue gas plenum), cause the gas to escape the separator 10 via this opening 22.

Therefore, due to the respective dispositions of inlet 18 and of outlets 15 and 22 and to appropriate gas velocities, a vortex flow is generated in chamber 10. The flow of gas and particles enters the chamber via inlet 18 and rotates while flowing downwardly along the walls of the chamber, thus forming the outer circulation of the vortex, in which particles are separated from gas thanks to centrifugal forces.

In the lower portion 14, the circulation is reversed and an inner circulation is generated, that rotates inside the outer circulation while flowing upwardly.

Some particles still carried in the inner circulation can be separated by centrifugation and then be carried downwardly by the outer circulation.

The dedusted gas of the inner circulation escapes chamber 10 through opening 22, whereas the separated particles escape this chamber through outlet 20.

The acceleration duct has a first end 15A which, as will be described herein-after, is adapted to be connected to an enclosure containing a mixture of gas and particles such as the combustion chamber of a fluidized bed reactor device, and a second end 15B that is connection to the separator chamber via the inlet 18 thereof.

Figure 2:
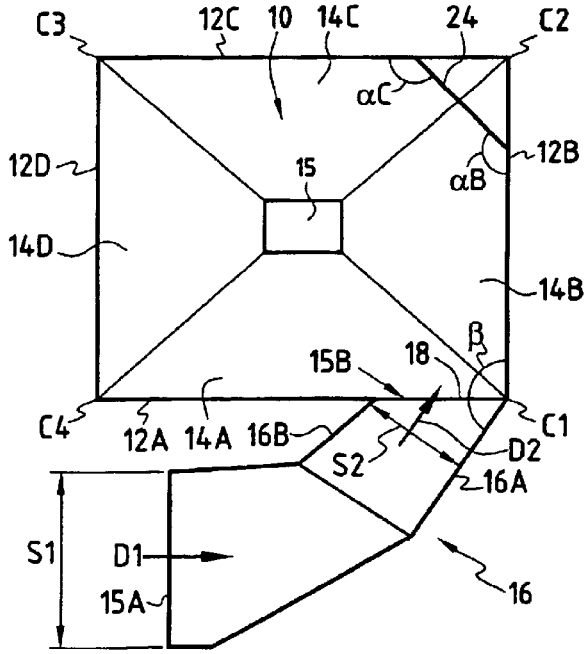
FIG. 2 is a section in plane II—II of FIG. 1.

As seen in FIG. 2, the transverse section S1 of the acceleration duct 16, as measured perpendicularly to the flowing direction D1 of the mixture of gas and particles at the first end 15A, is significantly bigger than the transverse section S2 of duct 16, as measured perpendicularly to the flowing direction D2 of the mixture of gas and particles at the second end 15A. S1 is advantageously 1.3 to 2.2 times bigger than S2, for example 2 times bigger.

The acceleration duct is connected to the separator chamber at the first corner C1 thereof, the outer side wall of the duct being directly connected to the second wall 12B of the chamber at corner C1.

The second end of the acceleration duct forms an obtuse angle with the second wall 12B of the separator chamber. More precisely, such obtuse angle $\beta$ is measured between the inner face of the second wall and the inner face of outer side wall portion 16A of duct 16. Considering the global curvature of the flow of the mixture of gas and particles in the acceleration duct, outer side wall portion 16A is the most distant side wall portion of duct 16, with respect to the center of curvature. This outer side wall portion is also named wall portion of the extrados, whereas the opposite side wall portion 16B is also named wall portion of the intrados.

This angle is suitably at least 120° or, more suitably, at least 135°. As will be described herein-after, the acceleration duct can be composed of several substantially rectilinear duct portions, forming angles between them. Depending on the number of such duct portions and on their orientations one with respect to the other, angle $\beta$ can be substantially equal to 155° or even substantially equal to 180.

As is apparent in FIG. 1, the acceleration duct, at least at the second end thereof, is inclined downwardly in a direction towards the separator chamber.

Figure 5:
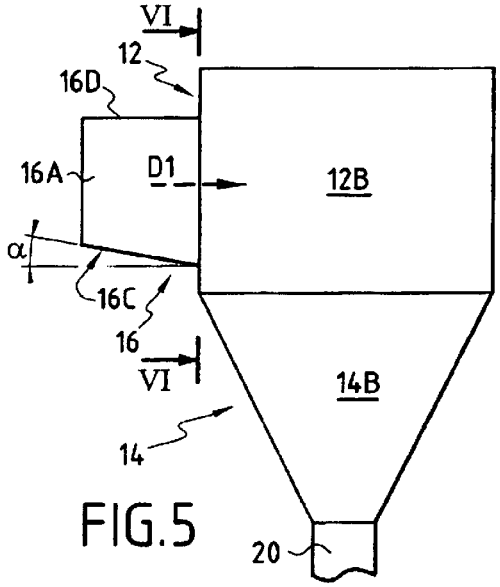
FIG. 5 is a side view of FIG. 1 as taken from arrow V.

More precisely, as seen in FIG. 5, the bottom wall portion 16C of duct 16 is inclined downwardly of an angle $\alpha$ with respect to the horizontal direction, in flowing direction D1. Angle $\alpha$ is advantageously comprised between 10° and 40°, suitably substantially equal to 30°.

Figure 6:
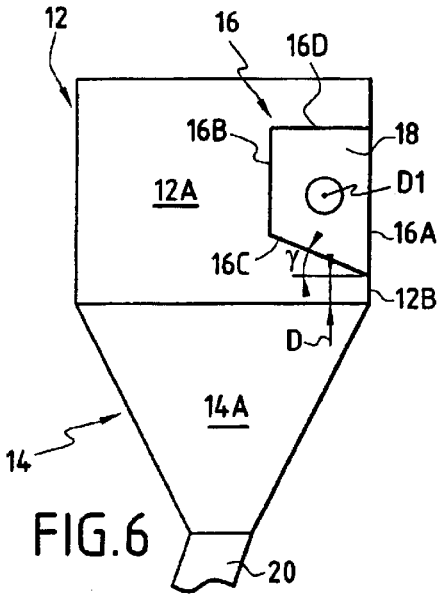
FIG. 6 is a cross section according to line VI—VI of FIG. 5

FIG. 6 shows that, in an advantageous example, bottom wall 16C is also inclined as seen in a transverse section perpendicular to flowing direction D1. Indeed, bottom wall 16C is inclined downwardly towards the outer side wall portion 16A of duct 16, of an angle $\gamma$ with respect to the horizontal direction. Said angle $\gamma$ is comprised between 0° and 40°, suitably between 10° and 40° and more suitably between 20° and 30°. For example, angle $\gamma$ is substantially equal to 26°.

FIG. 6 shows the lowest point of bottom wall portion 16C being located at a distance D above the upper end of the lower portion of the separator. Alternatively, this lowest point can be located on the said upper end. Suitably, distance D is not more than about 30% of the height of upper portion 12 of the separator chamber.

As seen in FIG. 6, the acceleration duct for example has four wall portions at the second end thereof, comprising a top wall portion 16D in addition to the above mentioned bottom and side wall portions. For the second portion of the duct to be inclined downwardly, it suffices that bottom wall 16C has such inclination, whereas top wall 16D can be substantially horizontal and whereas the side walls 16A, 16B can be substantially vertical. Indeed, due to the downward attraction of the outer circulation of the vortex, it suffices that bottom wall 16C be inclined downwardly for the mixture of gas and particles to have a downwardly oriented speed component has explained above.

In FIG. 2, a deflection wall member 24 is disposed at the corner C2 of the upper portion 12 of chamber 10, that is formed between the second and third walls 12B, 12C of this upper portion. This wall member can extend into the lower portion 14 of chamber 10 as shown in FIG. 1, or not.

FIG. 2 shows that the inner faces of the walls 12A and 12B are perpendicular, as well as the inner faces of the walls 12B and 12C. However, the deflection wall member 24 forms a non-perpendicular transition between the inner faces of these walls 12B and 12C.

Figure 3:
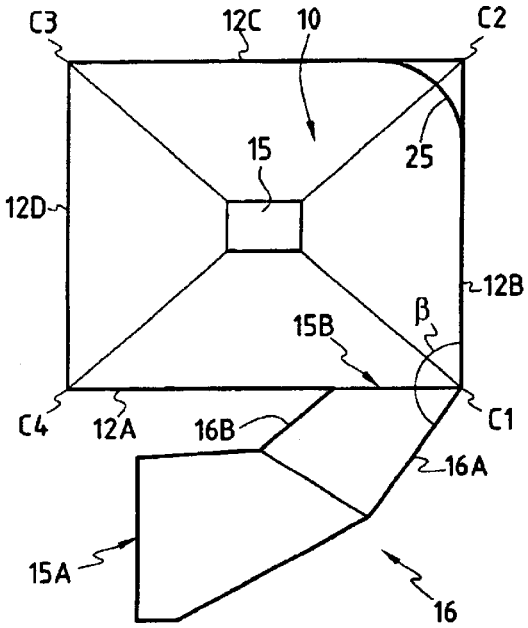
FIG. 3 is a view analogous to that of FIG. 2 and shows a variant of the first embodiment.
Figure 4:
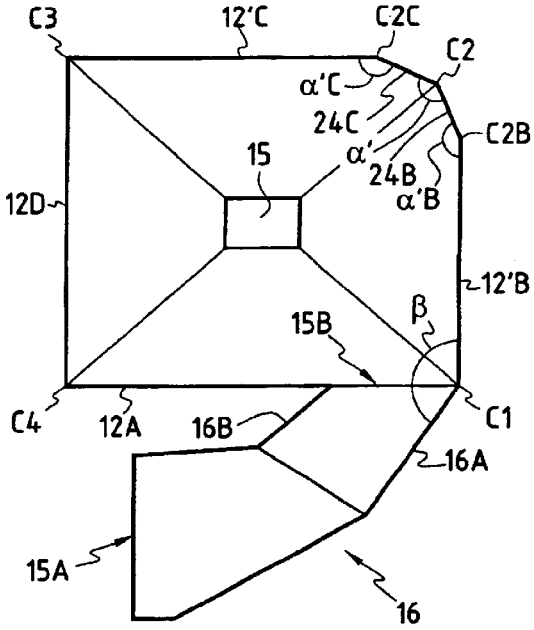
FIG. 4 is a view analogous to that of FIGS. 2 and 3, for another variant embodiment.

In the example shown in FIGS. 2 to 4, the deflection wall member has a planar inner face that forms an angle $\alpha$B with the second wall 12B (or rather with the inner face thereof) and an angle $\alpha$C with the third wall 12C (with the inner face thereof).

In the example shown, $\alpha$B and $\alpha$C are substantially equal to 135°, walls 12B and 12C being perpendicular and angles $\alpha$B and $\alpha$C being equal. Generally, angles $\alpha$B and $\alpha$C can be comprised between 105° and 165°.

It is also advantageous that angles $\beta$ and $\alpha$B be substantially equal. For example, angles $\beta$, $\alpha$B and $\alpha$C are each equal to 135°.

Thus, the flow of gas and particles entering the separator chamber is deviated at corner C1 in correspondence with angle $\beta$ and is then deviated at corner C2 in correspondence with angle $\alpha$B which has substantially the same value.

Therefore, the flow automatically adopts curvature that is substantially the same at corners C1 and C2 and that remains substantially unchanged in the whole chamber 10 without substantial flow disturbance.

Separated particles can be collected at corner C2 without a too substantial accumulation and without bouncing on the deflection wall means with a bouncing amplitude big enough for these particles to be re-circulated upwardly.

In the example of FIG. 3, the deflection wall member 25 that is located at corner C2 has a concave inner face, so that the transition at corner C2 between walls 12B and 12C is even smoother than in FIG. 2. In such case, it is preferred that wall member 25 be connected to walls 12B and 12C, respectively, in a substantially tangential manner, as is the case in FIG. 3.

The example of FIG. 4 shows a variant of FIG. 2, in which the deflection wall means situated at corner C2 between the second and third walls 12B and 12C of the upper portions of chamber 10 comprise several planar wall members. In this example, two wall members 24B and 24C are foreseen. Thus, three angles are formed at corner C2: angle α'B between wall 12'B and wall member 24B, angle α' between wall members 24B and 24C, and angle α'C between wall member 24C and wall 12'C.

This succession of angles enables a smooth transition between walls 12'B and 12'C to be achieved while the planar wall members 24A and 24B are easy to manufacture, in particular as to a possible refractory lining on the their inner faces.

Advantageously, angles α'B, α' and α'C are substantially equal one to the other and are substantially equal to angle β. For example, these angles can be all substantially to 150° or 155°. Generally speaking, it is advantageous that angles α'B and α'C be comprised between 105° and 165° an/or that α'B+α'+α'C be substantially equal to 450°.

In the examples of FIGS. 2 and 3, the second and third walls 12B, 12C of the upper portion 12 of chamber 10 meet at corner C2 while remaining perpendicular up to this corner. In other words, at corner C2, walls 12B and 12C delimit the enclosure of the upper portion 12 of chamber 10, and the deflection wall means (24, 25) are constituted by inner wall means that are disposed inside the chamber so as to rest on the inner faces of walls 12B and 12C.

In FIG. 4, the second and third walls 12'B and 12'C differ from walls 12B and 12C in that they do not end at corner C2 but at their respective connections, C2B and C2C with the deflection wall means. At corner C2, the outer faces of wall members 24A and 24B delimit the enclosure of the upper portion of chamber 10.

All the same, the deflection wall members 24 and 25 of FIGS. 2 and 3 can be formed of inner wall means disposed inside the chamber or they can delimit the enclosure of the chamber, as wall members 24B and 24C of FIG. 4 do. Reciprocally, said wall members 24B and 24C can be formed of inner wall means.

The inertia of the solids carried by the gas is a characteristic parameter of the flow of gas and particles entering the centrifugal separator. The outer wall 16A of the inlet duct collects some particles carried by the flow. Angle β at corner C1 is therefore advantageously wide open so as to avoid an accumulation of particles at this corner.

Wall 12B is the first wall that collects particles after they have entered chamber 10 and, as already indicated, outer wall 16A also collects particles within the inlet duct. Due to gravitation, these collected particles tend to accumulate towards the bottom of duct 16. Thanks to the downward inclination of the latter, the accumulated particles are easily discharged into chamber 10 and they reach the particles outlet very quickly while hardly being re-circulated by the flow of gas because the outer circulation of the vortex is helical (with a tangential downward orientation of about 30° to 45°), so that wall 12A is not affected by this outer circulation in the vicinity of opening 18.

Due to its tangential downward orientation, the flow of gas and particles reaches corner C2 at a horizontal level which is distinctly lower than the level of opening 18. The deflection wall means constitute a privileged downward path for the separated particles collected on these wall means.

Due to their orientation in a horizontal section, that achieves a non perpendicular transition between walls 12B and 12C of the chamber 10, the deflection wall means limit the shocks of particles and their tendency to be re-circulated upwardly. In addition, as indicated above, these deflection means collect some particles, so that a substantial separation of particles has already been operated when the flow reaches wall 12C. The fact that corner C3 between walls 12C and 12D and corner C4 between walls 12D and 12A form substantially right angles without deflection means being disposed at these corners does not substantially lower the separation efficiency, but it greatly simplifies the global construction of the separator.

Figure 7:
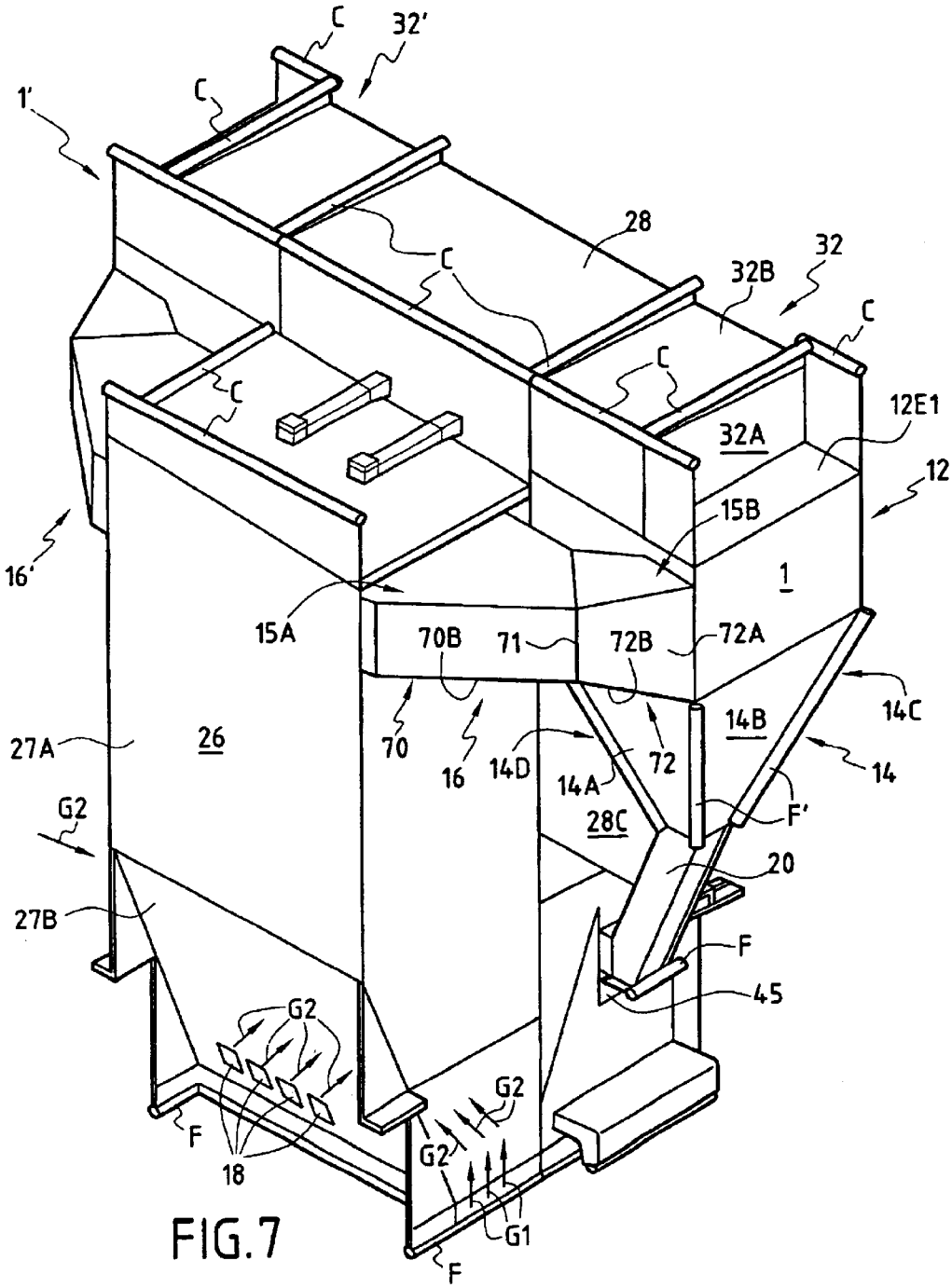
FIG. 7 is a perspective view of a reactor device including a separator according to the invention.

In FIG. 7, the separator 1 of the invention is implemented in a circulating fluidized bed reactor device 10 having an upstanding combustion reactor chamber 26, the centrifugal separator 1 and a back pass 28.

Figure 8:
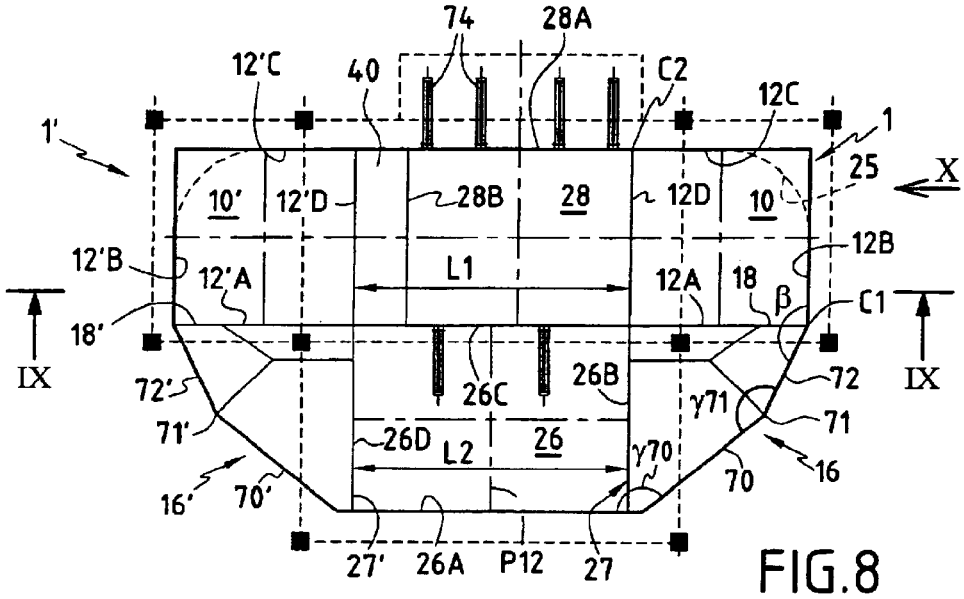
FIG. 8 is a top view of this reactor device.

As also seen in FIG. 8, the reactor chamber 26, that has a generally rectangular horizontal cross section, is delimited horizontally by walls 26A, 26B, 26C and 26D. In the example shown, the side walls 26B and 26D, as well as the rear wall 26C are planar walls that extend vertically.

Front wall 26A has an upper vertical planar portion 27A and a lower planar portion 27B that is inclined with respect to the vertical direction so that the cross section of chamber 26 increases upwardly. Angle A between lower portion 27B and the vertical direction is about 20° to 30° (see FIG. 10).

Chamber 26 has several inlets 30 for solid material such as fuel and sorbent particles, located in the lower third part of lower wall portion 27B. Further, as shown by arrows G1 in FIG. 7, the bottom of chamber 26 has means for introducing a primary fluidizing gas or fluidizing air into said chamber, so as to maintain a fluidized bed of solid particles in this chamber.

By way of example, this primary fluidizing gas or air can be introduced from a flue gas plenum located below chamber 26 and separated therefrom by a distribution plate having nozzles or the like.

In addition to this primary fluidization gas or air, a secondary fluidization gas or air can be introduced into chamber 26, in the lower part thereof but above its bottom wall, as shown by arrows G2. In the example shown, the secondary fluidization gas or air is introduced through the front wall and/or through the side walls of the chamber. In some cases, for example when the horizontal cross section of chamber 26 is important, the lower portion of this chamber can be divided in two leg-like portions, having facing wall portions through which secondary fluidization gas or air can be introduced into the chamber.

The fluidized bed generally flows upwardly in chamber 26 so that a flow of gas carrying particles escapes said chamber through an opening 27 (FIG. 8) located in the upper portion thereof. More precisely, opening 27 is disposed in a top portion of side wall 26B of the chamber.

This opening forms an outlet for the gas to be dedusted which is connected to the inlet 18 for gas to be dedusted formed in wall 12A of the separator 1, via the inlet duct 16 in which the mixture of gas and solids is accelerated. The disposition (orientation) of duct 16 with respect to chamber 26 is such that solids of the mixture of gas and solids circulating in duct 16 can be collected by the outer wall duct 16 which is connected to wall 12B of the separator chamber.

The opening 22 formed in the roof 12E of the separator enables dedusted gas to flow upwardly so as to escape the separator. A vortex finder 22A (see FIG. 9) is installed in this opening so as to guide the flow of gas. For example, the vortex finder can be a cylindrical skirt or a tapered skirt with an upwardly increasing cross section. The axis of this vortex finder can be vertically aligned with outlet 15 for the separated solids or can be somewhat offset towards a side wall of the separator and/or towards the front wall of the separator with respect to said outlet.

This opening 22 opens in a flue gas plenum 32, that is formed above the separator and that communicates with the back pass 28 in order to achieve the transfer of dedusted gas from the separator to the back pass which constitutes a vertical convection section provided with heat recovery surfaces 36 (FIG. 13) for recovering heat of the dedusted hot gas which flows downwardly in the back pass.

The flue gas escapes the back pass through an outlet formed in a lower portion thereof, in its rear wall 28A disposed opposite to the reactor chamber. The dedusted flue gas or part of it can be re-circulated in the reactor device, for example while being re-introduced into the reactor chamber or into the bubbling beds described herein-below, so as to serve as fluidization gas.

As best seen in the top view of FIG. 8, wall 26C of the reactor chamber is common to said chamber and to the back pass, and wall 12D of the separator is common to said separator and to the back pass. This wall 12D is an upward extension of side wall 28C of the back pass. Indeed, as seen in FIG. 7, only the upper part of the back pass in the first embodiment has a common wall with separator 1.

Considering that the reactor chamber (also named a combustion chamber) is situated in a front part of the reactor device, whereas the back pass (also named a back pass) is located in a rear part thereof, common wall 26C is a rear wall of the reactor chamber and a front wall of the back pass, whereas common wall 12D is a side wall of the separator and a side wall of the back pass. In the example shown, common walls 26C and 12D are perpendicular.

In the example shown, the reactor device has another separator 1', similar to separator 1. Separator 1' is disposed on the opposite side of the back pass, with respect to the separator 1 and its separator chamber 10' has an upper portion with four planar walls, 12'A, 12'B, 12'C and 12'D. Separator 1' has the same shape and structure as separator 1 and is symmetrical with respect thereto with respect to medium vertical front-rear plane P12 of the reactor device.

Side wall 12'D of this upper portion is disposed next to the back pass. However, a header box 40 is located between side wall 12'D of separator 1' and the side wall 28B of the back pass that is disposed opposite to common wall 12D. This header box accommodates feeding pipes F36 and collecting pipes C36 for the tubes forming the heat recovery surfaces in the back pass 28. The lower portion 14' of separator 1' is connected to a return duct 20' analogous to return duct 20.

The header box 40 is inserted between separator 1' and the back pass so that the reactor device as an overall compact structure despite the fact that separator 1' has no common side wall with the back pass.

Instead of header box 40, it could be advantageous to locate some headers in the bottom part of the back pass (where the flue gas is at relatively low temperatures of e.g. 450° C.) and the other headers above the back pass.

As seen in FIG. 8, the width L1 of the assembly constituted by the back pass and the header box, as measured from side wall 12'D of separator 1' to side wall 12D of separator 1, is equal to the width L2 of the reactor chamber 26 as measured from side wall 26B to side wall 26D of the latter.

Side walls 26B and 12D are aligned and, since L1 and L2 are equal, side walls 26D and 12'D are also aligned. Therefore, despite the implementation of header box 40 between the back pass and separator 1', the transferring means for conveying gas to be dedusted from the reactor chamber to, respectively, separator 1 and separator 1', can implemented in a symmetrical manner.

As a matter of fact, an opening 27' is formed in side wall 26D of the reactor chamber in a similar manner as opening 27 in side wall 26B, and forms a second outlet for gas to be dedusted, which is connected via an acceleration duct 16' to an inlet 18' for gas to be dedusted formed in wall 12'A of separator 1'.

The gas dedusted in separator 1' escapes the latter and enters in the back pass via a central opening formed in the roof of separator 1' and flue gas plenum 32', that is located above this roof and that communicates with the back pass as flue gas plenum 32 does.

The front wall 12A of separator 1 is aligned with the front wall of the back pass 28, formed by common wall 26C. In other words, this front wall forms an extension of this wall 26C, aligned with this wall. Similarly, front wall 12'A of separator 1' forms an extension of wall 26C.

In the illustrated example, the rear wall of the back pass is also aligned with the rear walls 12C, 12'C, of the separators 1, 1'.

The particles that are separated from the gas in the separator 1 are re-circulated by means of return duct 20 that is connected to the outlet 15 for solids at the bottom of the lower portion 14 of separator 1.

In the example shown in FIGS. 7 to 10, there are two complementary paths for re-introducing the particles from this return duct into the reactor chamber.

The first re-injection path is a direct one. Indeed, the bottom part of return duct 20 has a particle seal, for example a seal pot 44 acting as a siphon, the outlet of which is connected to a re-introduction duct 46 by means of which the particles passing the seal pot are re-introduced in the reactor chamber 26, in the vicinity of the lower part thereof.

Figure 10:
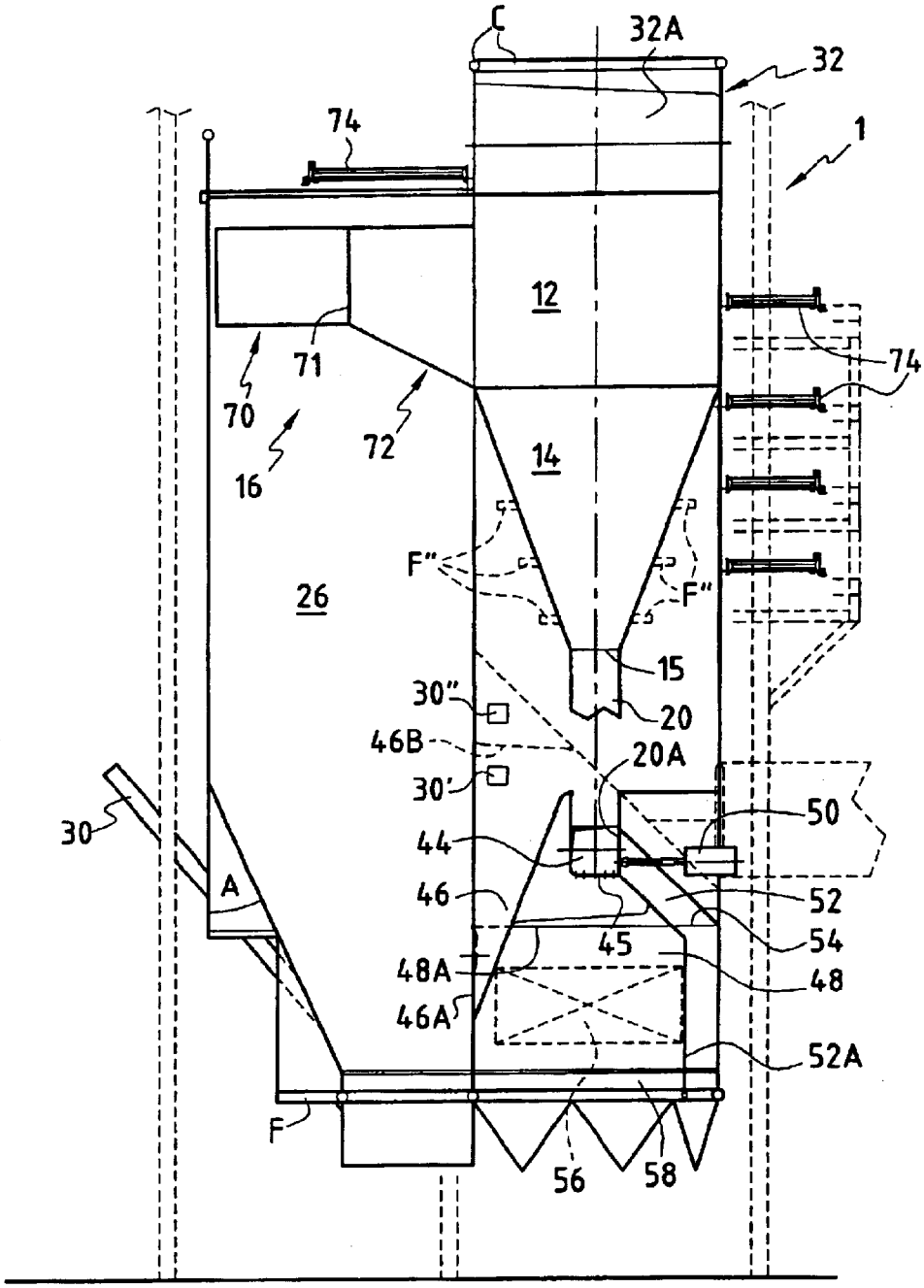
FIG. 10 is a side view according to arrow X of FIG. 8.

In addition to the above mentioned inlets 30, or as an alternative thereto, some inlets for fresh particles (including fuel sorbent particles) can be formed so that these fresh particles be introduced into chamber 26 via the re-introduction duct. For example, as shown in FIG. 10, one or several fresh particles inlets can comprise inlets 30' formed in the outer side wall of duct 46 so as to directly communicate with this duct 46 or inlets 30" located just above duct 46, so as to communicate with this duct through roof 46B thereof (in the latter case, this roof has adapted openings).

Fluidization gas or air is introduced into the seal pot, in the lower part thereof, via gas inlets 45 formed in the bottom wall of the seal pot, said bottom wall separating the seal pot from an air inlet box 47 located under the said seal pot.

In the second re-injection path, the particles enter a heat exchanger area 48 located under the back pass 28 and, from this heat exchanger area, they are re-introduced into the reactor chamber, in a lower portion thereof.

To this effect, the bottom part of return duct 20 has a wall portion 20A provided with an opening that can be opened or closed by means of a solids flow control valve 50 controlled by any suitable control means.

For example, the solids flow control valve 50 can be controlled pneumatically or hydraulically. When this valve is opened, return duct 20 is connected to a drawing duct 52 via the above mentioned openings formed in wall portion 20A that separates the return and drawing ducts.

Duct 52 is connected to heat exchanger area 48 by an opening 54 formed in the roof 48A of said area. The front wall 52A of duct 52 extends in area 48 so as to be connected to the bottom of the reactor device, but only on a small portion of the width of said area.

Heat exchanger area 48 has heat exchanging surfaces 56 disposed therein and forms a bubbling bed into which a bubbling gas is introduced via a gas or air inlet box 58 located under heat exchanger area 48.

In this bubbling bed, depending on the gas speed and on the extent of opening of valve 50, the density of particles can be higher than in the fluidized bed created in the reactor chamber 26.

The heat exchanger area 48 has one or several particles outlets for the particles in the bubbling bed to be re-introduced into the reactor chamber, these outlets being suitably formed in a common wall between heat exchanger area 48 and chamber 26 that is aligned with common wall 26C between chamber 26 and the back pass 28 and that forms a lower portion of the rear wall of chamber 26. The reactor device can be top supported or bottom supported (which is suitable with the integrated bubbling beds).

The particles outlet 46A of re-introduction duct 46 enabling the separated particles in the separator 1 to be directly re-introduced into chamber 26 are also preferably located in this rear wall 26C.

Figure 9:
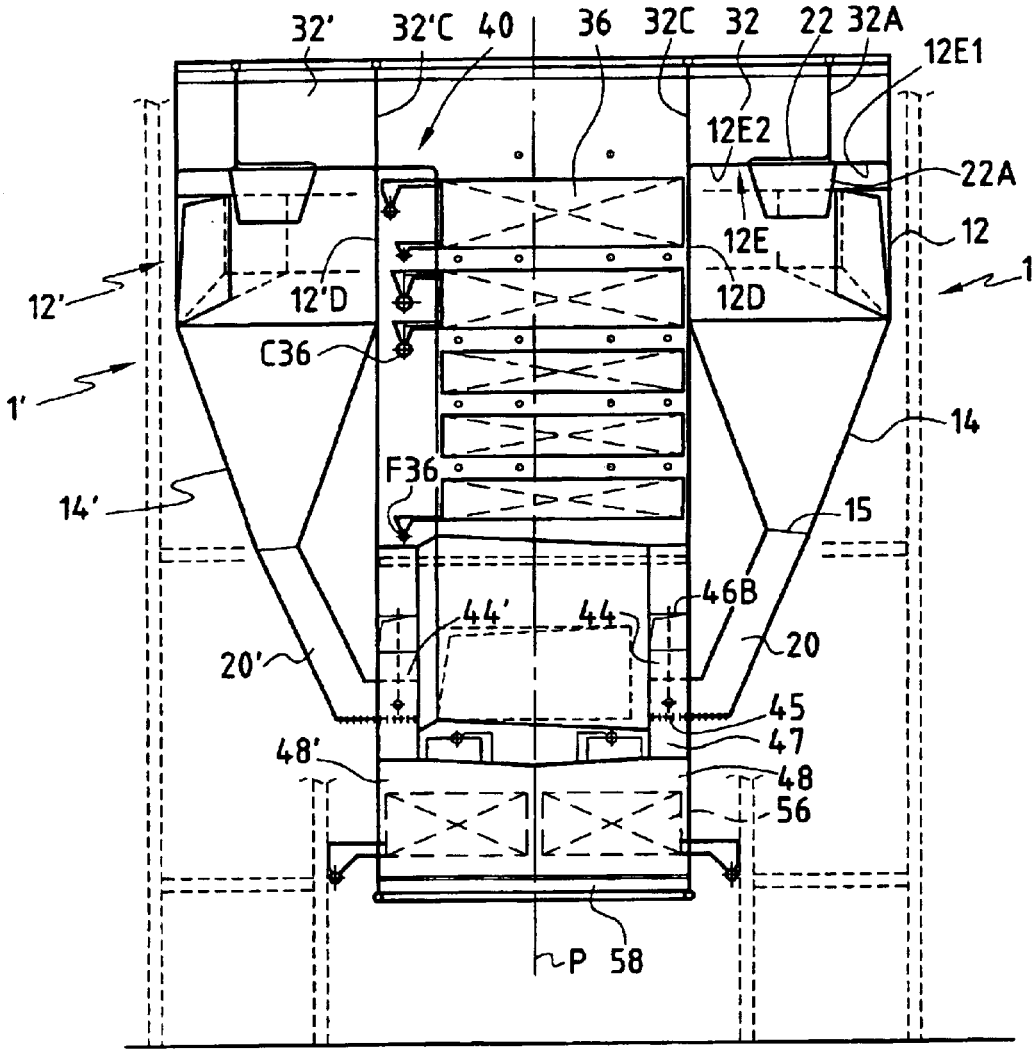
FIG. 9 is a section along line IX—IX of FIG. 8

The same possibility of using a direct re-injection path of separated particles and/or an indirect re-injection path via a heat exchanger area 48' is offered for separator 1' (see FIG. 9).

The different walls of the reactor device comprise heat exchange tubes in which a fluid transfer medium can circulate. Depending of the pressure and temperature conditions in the tubes, this heat transfer medium can be water, water steam or a mixture thereof.

Thus, walls 26A, 26B, 26C and 26D of the combustion chamber 26 form tube-fin-tube structures in the tubes of which the heat transfer medium circulates. This is also the case of walls 28A, 28B, 28C and 28D of the back pass 28 and of the walls of the heat exchanger areas.

The tubes of the vertical walls of chamber 26 and of back pass 28 can be bent so as to form the roofs thereof. For a better circulation of the emulsion that constitutes the heat transfer medium the tubes of these walls are orientated so that the flows circulates upwardly. Therefore, the roofs of chamber 26 and of back pass 28 are not horizontal, but they are slightly inclined upwardly (e.g. of 5°). On their inner sides, some areas of the walls of the combustion chamber are lined with a thin refractory layer, where adapted.

The walls of separator 1 also comprise tubes for circulation of a heat transfer medium, preferably dry steam. This also applies to the lower, hopper shaped portion of the separator. The same applies to separator 1'. It can also apply to the return ducts but, alternatively, the return ducts can be lined with a refractory material.

Figure 11:
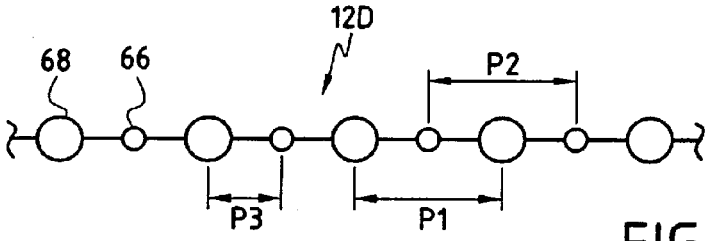
FIG. 11 is a horizontal section in the common wall between separator 1 and the back pass of the reactor device of FIG. 7.

As shown in the horizontal section of FIG. 11, the common wall 12D between the back pass and the separator 1 comprises tubes 66 that are connected to a series of heat exchange tubes in other walls of the separator (e.g. for circulating a first fluid transfer medium such as dry steam) and tubes 68 that are connected to a series of heat exchange tubes in other walls of the back pass (e.g. for circulating a second fluid transfer medium such as cooling emulsion). The tubes of these two series are alternated in common wall 12D, a tube 66 being disposed between two successive tubes 68. Wall 12'D can have a similar structure.

In the other walls of the back pass, in "normal" sections thereof, where the tubes are not bent (e.g. for forming openings), the tubes 68 are separated by a pitch P1 and in the "normal" sections of the walls of the separator, the tubes 66 are separated by a pitch P2. In the common wall 12D, it is advantageous that the tubes are not bent, so that pitches P1 and P2 remain unchanged. However, since tubes 66 and 68 are alternated, pitch P3 between two adjacent tubes in common wall 12D (a tube 68 and a tube 66) is about one half of pitches P1 and P2.

In the medium and lower portions of wall 28C of the back pass that extend below the common wall 12D, there only remain tubes 68, since tubes 66 of the common wall come from the tubing of lower portion 14 of the separator 1.

Acceleration duct 16 has substantially planar walls and, preferably, the cross sections of this duct perpendicularly to the flow of gas and particles are substantially rectangular.

The acceleration duct extends from outlet 27 formed in the side wall 26B of chamber 26, to inlet 18 formed in the front wall 12A of separator 1, in the upper portion 12 thereof. Suitably, outlet 27 is elongated in the horizontal direction, so as to be open over a substantial part of the length of wall 26B, which enables solids to be collected from chamber 26 over a wide portion of said wall 26B.

As best seen in FIGS. 7 and 8, duct 16 has a first part 70 connected to wall 26B and a second part 72 connected to wall 12A. These first and second parts present substantially planar walls and they are connected together at a knee 71 of duct 16.

Generally, the acceleration duct has a cross section, as measured perpendicularly to the flow of particles carrying gas within this duct, that decreases in the direction going from outlet 27 to inlet 18.

As a matter of fact, the first part 70 of the acceleration duct 24 has a cross section that decreases towards knee 71, whereas the second part 72 has a cross section that remains substantially unchanged from knee 71 to inlet 18.

At knee 71, the acceleration duct 16 forms an angle that is wide open. For example, angle $\gamma$71 between the outer side walls of parts 70 and 72 of duct 16 is comprised between 120° C. and 175°, advantageously between 140° and 175°, preferably close to 155°. Angle $\gamma$71 is advantageously substantially equal to angle $\beta$ at corner C1, so that the same deflection is given to the flow of gas and particles at angle $\gamma$71 and at angle $\beta$. A wide open angle $\gamma$71 prevents accumulation of particles at knee 71.

The first part 70 of duct 16 is connected to chamber 26 preferably at the corner between the front and side walls 26A, 26B of this chamber. Angle $\gamma$70 between the outer side wall of part 70 of duct 16 and the front wall 26A is advantageously greater than 130° and suitably substantially equal to 145°. It is advantageous that $\gamma$70+$\gamma$71+$\beta$ be substantially equal to 450°.

Lower wall 72B of duct 16 (of the second part 72 thereof) that is connected to the separator is inclined downwardly in a direction going towards the front wall 12A of the separator.

The acceleration duct suitably has its walls provided with tubes for circulation of heat transfer medium.

In such case, a first portion of the acceleration duct (possibly but not compulsorily the first part 70 thereof) comprises tubes that are connected, as far as circulation of the fluid transfer medium is concerned, to the tubes of the walls of combustion chamber 26, whereas a second portion of duct 16 (possibly but not compulsorily the second part 72 thereof) comprises tubes that are connected, as far as circulation of the heat transfer is concerned, to the tubes of the separator walls.

For example, tubes of the walls of the combustion chamber 26 are bent so as to extend into the walls of said first portion of duct 16, whereas tubes of the separator walls are bent so as to extend in the walls of said second portion of this acceleration duct. For example, the tubes of the lower wall of the first portion come from side wall 26B of the reactor chamber, the two halves of these tubes are bent so as to respectively form the two side walls of the said first portion, and they are further bent and gathered so as to form the upper face of this first portion and then to join side wall 26B above the acceleration duct. The conformation of the second portion of the acceleration duct is analogous, with tubes coming from the front face of the separator.

Bending these tubes also defines the respective openings forming respectively outlet 27 in wall 26B and inlet 18 in wall 12A.

This enables to form the walls of duct 16 with heat exchange tubes without the necessity of providing any specific feeding means or collecting means for the heat transfer medium that circulates in these tubes.

The lower wall 70B of first part 70 of duct 16 is slightly inclined upwardly in the direction going away from wall 26B for an upward circulation of the emulsion forming the heat transfer medium in the tubes of said first part, until knee 71.

The cross section of duct 16 in the vicinity of inlet 18 is about half the cross section of this duct in the vicinity of outlet 27, these cross sections being measured perpendicularly to the flow of gas and particles in the acceleration duct 16.

Likewise, the acceleration duct 16' that connects chamber 26 to separator 1' is formed of two parts, respectively 70' and 72' connected at knee 71'. Acceleration ducts 16 and 16' are similar and symmetrical with respect to the medium plane of symmetry P12. In particular, the first and second parts 70', 72' of duct 16' are equipped with tubes respectively connected to the tubes of the walls of chamber 26 and to the tubes of the walls of separator 1'.

The acceleration duct(s) as well as (as described hereinbelow) the return duct(s) advantageously have their walls provided with tubes for circulation of a heat transfer medium. Alternatively, it is also possible that the acceleration duct(s) and/or the return duct(s) be lined with a refractory material.

The walls of separator 1 comprise tubes as indicated below.

The roof 12E of the separator 1 has an outer portion 12E1, that is remote from common wall 12D and that is formed of bent tubes coming from outer side wall 12B, these tubes being bent in the vicinity of opening 22 so as to form the upright side wall 32A of flue gas plenum 32 (see FIGS. 1, 7, 9 and 13).

The other part 12E2 of roof 12E is also equipped with heat exchange tubes. In this case, these tubes come from tubes 66 of common wall 12D that are bent so as to extend substantially horizontally. These tubes are further bent while remaining in a substantially horizontal plane, so as to form opening 22, and are then bent once more so as to extend vertically and to pertain to outer side wall 32A of the flue gas plenum.

Some of the tubes that are bent around opening 22 can extend vertically in the vicinity of this opening so as to support the roof 12E and the vortex finder 22A; these tubes go through roof 32B of the flue gas plenum so as to be connected to an outer supporting structure. In addition some tubes 68 coming from common wall 12D can be routed in roof 12E2, then extended vertically in areas where supports are required for roof 12E2; these tubes go through roof 32B of the flue gas plenum so as to be connected to an outer supporting structure. Roof 12E2 can be a single wall common to separator 1 and plenum 32 or a double wall structure with or without intermediate stiffening means.

The outer side wall 32A has tubes coming from both side walls 12D and 12B of separator 1 so that the pitch between two adjacent tubes of this wall is about half the pitch in walls 12D and 12B. Alternatively, the tubes coming form the two faces can be connected by pairs by means of connections such as T fittings at the bottom of wall 32A, so that the pitch is unchanged in wall 32A.

The front and rear walls of flue gas plenum 32 extend as vertical extensions of, respectively, front and rear walls 12A and 12C of separator 1 and are therefore equipped with the heat exchange tubes of these respective walls.

The roof 32B of flue gas plenum 32 also comprises heat exchange tubes formed by bent tubes coming from the front and/or the rear walls of this flue gas plenum.

In the example shown, the tubes of roof 32B come from the tubes of rear wall 12C of the separator, these tubes being bent so as to extend substantially horizontally with a slight upward inclination towards the front wall.

The flue gas plenum 32 has its inner side wall 32C that forms a common wall between the flue gas plenum and the back pass. In fact, this common wall extends as an upper vertical extension of common wall 12D between the separator and the back pass and it is formed by the upper end of side wall 28C. Therefore, the said common wall between the flue gas plenum and the back pass is equipped with those heat exchange tubes that are disposed in wall 28C.

The common wall between the flue gas plenum 32 and the back pass 28 has one or several openings formed therein for the dedusted gas flowing from the vortex in separator 1 into the flue gas plenum, to enter the back pass.

This or these openings are preferably formed by bent portions of the tubes that are disposed in the common wall between the flue gas plenum and the back pass.

Alternatively or complementarily, the walls of the flue gas plenum or parts of these walls can have a refractory lining.

The same applies to the flue gas plenum 32' located above separator 1' as to the tube-fin-tube structure of its walls.

The reactor device has headers F and C for feeding and collecting the heat transfer medium circulating in the heat exchange tubes. In general, the headers F that are located at the bottoms of the walls of the reactor device are feeding headers, whereas the headers C that are located at the upper ends of the walls are collecting headers.

Due to its hopper like form, the lower portion 14 of separator 1 has some intermediate feeding and/or collecting headers F' disposed at the angles between its walls according to their increasing surfaces in the upwards direction. The same applies to separator 1'. These intermediate feeding/collecting headers can extend along or within the inclined edges of the lower portion of the separators where two adjacent sides thereof meet, as shown, or they can extend horizontally as suggested at F" in FIG. 10.

Each side 14A, 14B, 14C and 14D of the pyramid 14 that forms the lower portion of the separator chamber 10 is connected to one wall of the upper portion, respectively 12A, 12B, 12C and 12D.

As already explained, the walls of chamber 10 comprise heat exchange tubes. Preferably, the heat exchange tubes that extend in a side 14A, 14B, 14C or 14D of the pyramid also extend in the wall 12A, 12B, 12C or 12D of the upper portion 12 of chamber 10 situated above the side in question.

The heat transfer tubes substantially extend vertically in a side of the pyramid while being inclined with respect to a vertical plane comprising the wall of the upper portion of the separator that extends above this side. The tubes extend substantially vertically in the walls 12A, 12B, 12C or 12D.

Preferably, the horizontal distance between two adjacent tubes that extend in a side of the pyramid and in the wall of the upper portion 12 that is connected to this side remains substantially unchanged in said side and in said wall.

As already mentioned, the return duct 20 also can have its walls provided with heat exchange tubes.

As can be understood upon considering FIG. 7, the return duct has four sides, each of which is connected to one edge of opening 15 formed by the lower end on one pyramid side. Each side of the return duct is provided with substantially vertically extending heat exchange tubes (while taking into account the overall inclination of duct 20 with respect to the vertical direction) and these heat exchange tubes also extend in this pyramid side to the lower end of which the side of the return duct in question is connected.

In other words, the heat exchange tubes fed or discharged at F, at the bottom of the return duct 20 extend in the sides of this return duct, are bent so as to extend in the corresponding sides of the pyramid and are bent once more so as to extend in the corresponding walls of the upper portion of the separator chamber. Throughout their whole lengths, the pitches between these tubes remain substantially unchanged except in specific areas. Such a specific area is the vicinity of opening 18 where the tubes of wall 12A are bent for forming this opening and for extending in part 72 of the inlet duct 16.

Although dedusted in the separators 1 and 1', the gas that flows in the back pass carries a small amount of particles in the form of flying ashes. It is therefore necessary to regularly clean up the heat recovery surfaces 36 inside the back pass. This is why soot blowers 74 that can be moved to and fro in the back pass are shown in the drawings.

Figure 12:
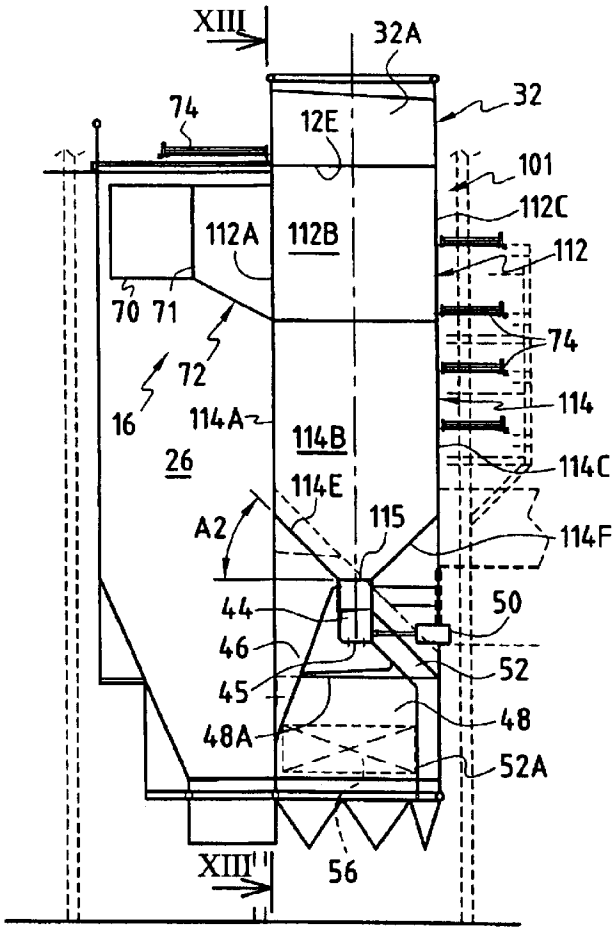
FIG. 12 is a side view analogous to that of FIG. 10, showing a variant embodiment.
Figure 13:
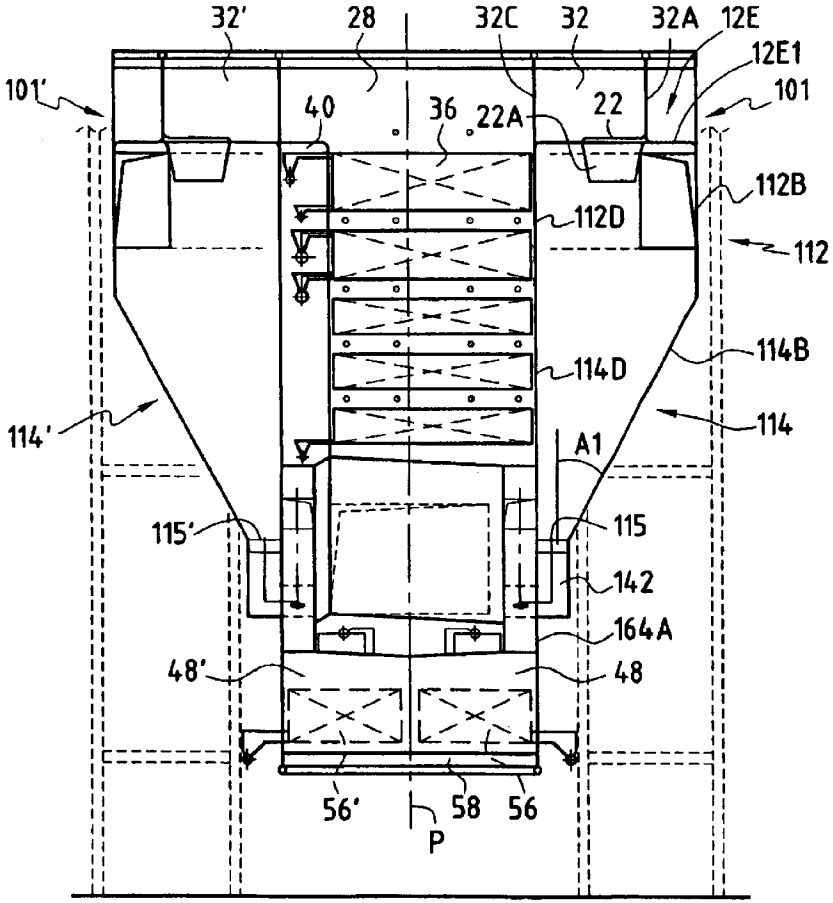
FIG. 13 is a vertical section along line XIII—XIII of FIG. 12.

FIGS. 12 and 13, that show a variant embodiment of the reactor device according to the invention are described hereinafter.

In this variant embodiment, the separators differ from separators 1 and 1' as to their lower portions.

Separator 101 has an upper portion 112, analogous to upper portion 12 of separator 1 and likewise connected to the combustion chamber 26 by inlet duct 16 and to back pass 28 via an opening 22 in its roof that opens in flue gas plenum 32.

Separator 101 also has a lower portion 101 of which the horizontal cross section decreases downwards.

Wall 112D of the separator 101, which forms an inner side wall thereof, is a common wall between the separator and the back pass. Unlike the variant of the preceding figures, this common wall extends not only in the upper portion of the separator, but also in the lower portion thereof.

The outer side wall of the separator has an upper portion 112B that is parallel to the inner side wall 112D and a lower portion 114B that is inclined towards the inner side wall in the downward direction, so that the cross section of lower portion 114 decreases. The upper portion 112 of separator 101 has a substantially square cross section, whereas the lower portion 114 has a substantially rectangular cross section, the length of which is equal to the length of one side of the square cross section of the upper portion.

As a matter of fact, the lower portion 114 of the separator has a first wall 114A, a third wall 114C and a fourth wall 114D that are substantially vertical planar walls and that extend vertically as respective downward extensions of the first, third and fourth walls 112A, 112C and 112D of the upper portion of the separator 101. In fact, for each of these three sides of the separator, the limit between the walls of the upper and lower portions is not visible.

The second wall 114B of the lower portion 114 is also a substantially planar wall. It extends under the second wall 112B of the separator and is inclined towards the fourth wall 114D of lower portion 114.

The inclination A1 of wall 114B with respect to the vertical direction is advantageously comprised between 25° and 45°, preferably 35°.

The lower part 114 of the separator 101 has a bottom wall having respective front and rear portions 114E and 114F, respectively connected to the front and rear walls 112A, 112C and inclined downwardly from these respective walls towards outlet 115 for solids separated in the separator.

The inclination A2 of bottom wall portions 114E, 114F with respect to the horizontal direction is advantageously comprised between 45° and 70° (e.g. about 50°).

Therefore, the converging part of separator 101 formed by the lower portion thereof is essentially obtained by the inclined outer side wall 114B of the separator with the other three outer walls thereof remaining substantially vertical over substantially the whole height of the separator. Only at a small distance above outlet 115 are the lower ends of the vertical front and rear walls 112A, 112C connected to this outlet 115 via slightly inclined bottom wall portions. The inner side wall 112D, 114D of separator 101 remain vertical over its whole length.

This enables the overall structure of the separator to be very simple and in particular, it facilitates the tube or tube-fin-tube constitution of the separator walls since the outer side wall 112B, 114B of the separator can have the same number of tubes disposed therein from its lower end up to its upper end. Tubes are to be added only in the front and rear walls 114A, 114C of the lower portion 114 as a function of their increasing horizontal lengths in the upward direction.

Concerning the construction of wall 112D, 114D with tubes, two advantageous possibilities are offered.

The first one consists in providing in this wall only tubes that are connected, as to circulation of a heat transfer medium, to the tubes that are disposed in the other walls of the back pass. This possibility is advantageous as far as costs are concerned.

The other possibility consists in having walls 112D, 114D equipped with tubes belonging to a series of heat exchange tubes for the walls of the back pass and with tubes belonging to a series of heat exchange tubes for the walls of the separator in the same manner as shown for wall 12D in FIG. 11.

The second possibility provides for a high heat exchange rate.

If needed for structural reasons, in both cases described above, a double wall structure can be used.

The upper wall 12E of separator 101 is analogous to that of separator 1, with its two parts 12E1 and 12E2.

Under outlet 115, the return duct 142 is built on a side wall 164A, the upper part of which forms the common wall 112D between the back pass and the separator. This side wall 164A is the side wall of the substantially parallelepiped structure including the back pass and the bubbling beds with their heat exchange areas 48, 48' located under the back pass. The lower end of duct 142 is connected to seal pot 44 in the same way as lower end of duct 42 is connected to the seal pot in the preceding figures.

The other separator 101' has a structure that is similar to that of separator 101 and is symmetrical with this separator with respect to a medium plane P.

The separator of the invention can also be implemented in a circulating fluidized bed reactor device, that does not comprise bubbling beds such as 48 and 48' and in which particles separated in the separator(s) are directly re-introduced in the combustion chamber. In such case, this chamber advantageously comprises heat exchanging means such as panels provided with heat exchange tubes disposed in said chamber. Such panels can also be provided even if the device comprises bubbling bed(s).

These panels can extend in the chamber from one wall to an opposite wall thereof and act as stiffening means for these walls.

In the variant embodiment of FIGS. 12 and 13, the lower portions 114, 114' of the separators have only one inclined wall (with the exception of bottom wall portions 114E and 114F) and therefore do not present the pyramidal shape of the separators in FIG. 7. In other words, the lower portions 114, 114' lack symmetry with respect to vertical axis aligned respectively with outlets 115, 115' for separated solids.

Nevertheless, this conformation provides for excellent separation efficiency since the inclined walls 114, 114' are not facing the inlets for gas and particles in the separators (these inlets being formed in the front walls as wall 112A, and the inclined walls being located under side walls of the upper portions of separator and not under their rear walls).

Therefore, the particles entering the separators and falling rapidly do not tend to bounce on to these inclined walls and they are not re-circulated easily.

Figure 14:
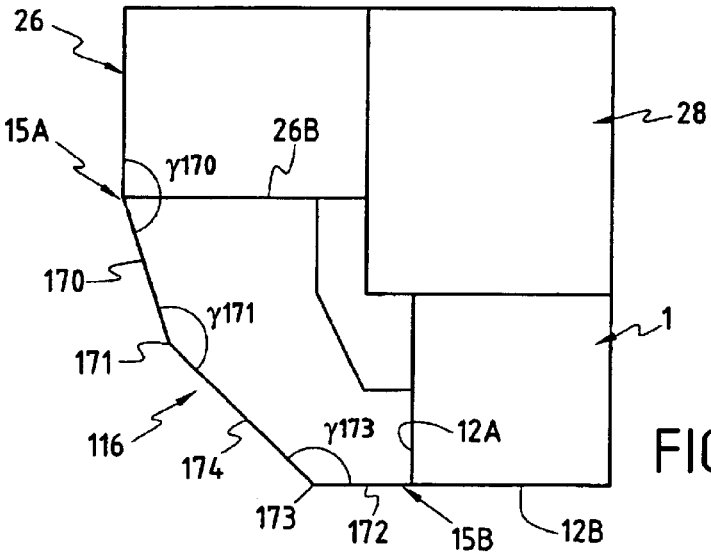
FIG. 14 is a top view of a reactor device showing a variant embodiment.

The top view of FIG. 14 shows the acceleration duct 116 of the reactor device comprising three parts forming angles between them. More precisely, it comprises a first part 170 connected to the reactor chamber (to side wall 26B thereof), a second part 172 connected to the separator (to the first wall 12A of the upper portion thereof) and also an intermediary part 174 that extend between parts 170 and 172. The intermediary part forms an angle $\gamma$171 with the first part 170, at knee 171 where it meets said first part, and it forms an angle $\gamma$173 with the second part 172, at knee 173 where it meets said second part. This structure of the acceleration duct enables angle $\beta$ between the second part and the second wall 12B of the separator chamber to be even wider open as in the examples of the preceding figures. This angle $\beta$ can even be substantially equal to 180°. This is achieves while the angles $\gamma$171 and $\gamma$173 between the several parts of the acceleration duct remain obtuse angles, so as to prevent too much flow disturbance and accumulation of particles within the acceleration duct. The angles $\gamma$170, $\gamma$171 and $\gamma$173 are measured at the wall portion of the extrados in the acceleration duct.

For example, $\gamma$171 and $\gamma$173 are comprised between 100° and 170°, suitably between 120° and 170. It is advantageous that $\gamma$170+$\gamma$171+$\gamma$173 be substantially equal to 450°.

In anyone of the above described embodiments, it is advantageous that the first end of the acceleration duct has a vertical height that is smaller than its horizontal length (e.g. 0.3 to 1.5 smaller) whereas the second end of this duct, which is connected to the separator chamber, has vertical height that is bigger than its horizontal length (e.g. 1.5 to 4 times bigger). It is also advantageous that the length of the acceleration duct, as measured along the flow of the mixture of gas and particles in said duct, be comprised at least 0.6 times the horizontal length of the second wall of the separator chamber, as measured on the inner face thereof. Suitably, this length of the acceleration duct is not more than 1.5 times the length of this second wall.

What is claimed is:

1. A centrifugal separator for separating particles from gas, comprising a separator chamber that comprises an upper portion delimited horizontally by walls and a lower portion having a downwardly decreasing horizontal cross section, the separator having means for defining therein a vertical gas vortex that comprise an inlet for gas to be dedusted formed in the upper portion of the chamber, an outlet for dedusted gas formed in said upper portion, and an outlet for separated particles formed in the lower portion of the chamber, said walls of the upper portion comprising at least first, a second and a third substantially vertical planar walls, located one next to the other in the direction of flow of said gas vortex and defining three substantially vertical planar inner faces of said upper portion, said inlet for gas to be dedusted being formed in the vicinity of a first corner defined between said first and second walls, the inner faces of the first and second walls being substantially perpendicular and the inner faces of the second and third wall being substantially perpendicular, the separator comprising an acceleration duct for accelerating a mixture of gas and particles circulating in said duct, from a first end to a second end thereof, before said mixture enters said separator chamber, a first transverse section of said acceleration duct at said first end thereof being distinctly greater than a second transverse section of said acceleration duct at said second end thereof, the second end of the acceleration duct being connected to said inlet for gas to be dedusted at the first corner, while forming an obtuse angle with said second wall, and said second end of the acceleration duct being inclined downwardly in a direction towards the separator chamber.

2. The separator as claimed in claim 1, wherein said second end of the acceleration duct is connected to the first wall of the separator chamber, at the first corner, while forming an angle of at least 120° with said second wall.

3. The separator as claimed in claim 1, wherein said second end of the acceleration duct is inclined downwardly in a direction of flow of said mixture of gas and particles at said second end.

4. The separator as claimed in claim 3, wherein said second end has a downward inclination of 10° to 40° with respect to a horizontal plane in a direction of flow of said mixture of gas and particles at said second end.

5. The separator as claimed in claim 1, wherein, in a transverse cross section substantially perpendicular to a direction of flow of said mixture of gas and particles at the second end of the acceleration duct, said second end is inclined downwardly in the direction going towards the second wall of the separator chamber.

6. The separator as claimed in claim 5, wherein, in a transverse cross section, the second end of the acceleration duct has a downward inclination of 10° to 40° with respect to a horizontal direction.

7. The separator as claimed in claim 1, wherein the acceleration duct has wall portions that, at least at the second end of said duct, include a bottom wall portion that is inclined downwardly in a direction going towards the separator chamber.

8. The separator as claimed in claim 7, wherein said wall portions further comprise a wall portion of the extrados disposed on an outer side of the acceleration duct, and in that the bottom wall portion is inclined downwardly in a direction towards said wall portion of the extrados.

9. The separator as claimed in claim 1, wherein the first transverse section of said acceleration duct at said first end thereof is 1.3 to 2.2 times bigger than the second transverse section of said acceleration duct at said second end thereof.

10. The separator as claimed in claim 1, comprising deflection wall means disposed at a second corner that is formed between said second and third walls so as to form a non perpendicular transition between the inner faces of said second and third walls.

11. The separator as claimed in claim 10, wherein the deflection wall means comprise a deflection wall member having a substantially planar inner face that forms with the second wall an angle substantially equal to the angle formed between the inlet duct and said second wall.

12. The separator as claimed in claim 10, wherein the deflection wall means comprise a deflection wall member having a concave inner face.

13. The separator as claimed in claim 1, wherein the upper portion of the separator chamber is delimited by four substantially vertical planar walls the inner faces of which delimiting a horizontal cross section that defers from a rectangular cross section in that the deflection wall means are disposed in said second corner.

14. The separator as claimed in claim 1, wherein the lower portion of the separator chamber has the form of a pyramid having downwardly converging walls.

15. The separator as claimed in claim 1, wherein the upper portion of the separator chamber has a fourth substantially vertical planar wall arranged between said first and third walls thereof and the lower portion (114) of said chamber comprises four walls among which a first, a third and a fourth substantially vertical planar walls extend vertically as respective downward extensions of said first, third and fourth walls of the upper portion, whereas the second wall of this lower portion is a substantially planar wall, that extends under said second substantially vertical planar wall of the upper portion and that is inclined towards said fourth substantially vertical planar wall of the lower portion.

16. The separator as claimed in claim 1, wherein the walls of the separator chamber comprise heat exchange tubes in which a fluid transfer medium can pass.

17. The separator as claimed in claim 1, wherein each side of the pyramid forming the lower portion of the separator chamber is connected to one wall of the upper portion of said chamber, and wherein heat exchange tubes in which a heat transfer medium can pass extend substantially vertically in a side of the pyramid also extend substantially vertically in the wall of the upper portion that is connected to said side.

18. The separator as claimed in claim 17, wherein the horizontal distance between two adjacent tubes that extend in a side of the pyramid and in the wall of the upper portion that is connected to this side remains substantially unchanged in said side and in said wall and wherein some additional heat exchange tube connected to fluid feeding means that extend on the edges of the pyramid are added in the sides thereof as the horizontal lengths of these sides increase upwardly.

19. The separator as claimed in claim 15, wherein heat exchange tubes in which a heat transfer medium can pass extend substantially vertically in a wall of the upper portion of the separator chamber and also extend in the wall of the lower portion of said chamber that extends under said wall of the upper portion while being connected thereto.

20. The separator as claimed in claim 19, wherein the second and fourth walls of the lower portion of the separator chamber have horizontal lengths that remain substantially unchanged over the heights thereof, whereas said first and third walls of said lower portion have horizontal lengths that increase in the upward direction of said walls, wherein the horizontal distance between two adjacent heat exchange tubes that extend in a wall of the lower portion of the separator chamber and in the wall of the upper portion that is connected to this side remains substantially unchanged in said walls and wherein some additional heat exchange tubes connected to fluid feeding means that extend on edges of said first and third walls are added in said walls as the horizontal lengths of these walls increase upwardly.

21. The separator as claimed in claim 1, wherein the outlet for dedusted gas comprises an opening formed in a substantially horizontal roof of the upper portion of the separator chamber, said roof comprising heat exchange tubes in which a fluid transfer medium can pass and said opening being formed by bent portions of said tubes.

22. A circulating fluidized bed reactor device comprising a reactor chamber delimited horizontally by walls, a centrifugal separator and a back pass for heat recovery, the reactor device comprising means for introducing a fluidizing gas into the reactor chamber and for maintaining a fluidized bed of particles in said chamber, and further comprising a centrifugal separator for separating particles from gas comprising a separator chamber and an acceleration duct, the reactor device further comprising means for transferring gas to be dedusted from the reactor chamber into the separator via the acceleration duct, means for discharging separated particles from the separator via said outlet for separated particles and means for transferring dedusted gas from the separator into the back pass via said outlet for dedusted gas, wherein the separator comprises an upper portion delimited horizontally by walls and a lower portion having a downwardly decreasing horizontal cross section, the separator having means for defining therein a vertical gas vortex that comprise an inlet for gas to be dedusted formed in the upper portion of the chamber, an outlet for dedusted gas formed in said upper portion, and an outlet for separated particles formed in the lower portion of the chamber, said walls of the upper portion comprising at least a first, a second and third substantially vertical planar walls, located one next to the other in the direction of flow of said gas vortex and defining three substantially vertical planar inner faces of said upper portion, said inlet for gas to be dedusted being formed in the vicinity of a first corner defined between said first and second walls, the inner faces of the first and second walls being substantially perpendicular and the inner faces of the second and third walls being substantially perpendicular, the acceleration duct having a first end and a second end, a first transverse section of said acceleration duct at said first end thereof being distinctly greater than a second transverse section of said acceleration duct at said second end thereof, the second end of the acceleration duct being connected to said inlet for gas to be dedusted at the first corner, while forming an obtuse angle with said second wall, and said second end of the acceleration duct being inclined downwardly in a direction towards the separator chamber.

23. The reactor device as claimed in claim 22, wherein the upper portion of the separator has a fourth substantially vertical planar wall arranged between said first and third walls thereof, and wherein said fourth wall is a common wall between the separator and the back pass.

24. The reactor device as claimed in claim 22, comprising a common wall between the back pass and the reactor chamber which is a front wall of the back pass and a rear wall of the reactor chamber, the first wall of the upper portion of the separator being parallel to said common wall between the back pass and the reactor chamber, whereas the reactor chamber has a side wall that is parallel to the fourth wall of the upper portion of the separator.

25. The reactor device as claimed in claim 22, wherein the acceleration duct extends from said side wall of the reactor chamber to said first wall of the upper portion of the separator.

26. The reactor device as claimed in claim 24, wherein the first wall of the upper portion of the separator and the common wall between the back pass and the reactor chamber are aligned.

27. The reactor device as claimed in claim 23, comprising a common wall between the back pass and the reactor chamber which is a front wall of the back pass and a rear wall of the reactor chamber, the first wall of the upper portion of the separator being parallel to said common wall between the back pass and the reactor chamber, whereas the reactor chamber has a side wall that is parallel to the fourth wall of the upper portion of the separator, wherein said side wall of the reactor chamber and the common wall between the separator and the back pass are aligned.

28. The reactor device as claimed in claim 23, wherein the means for transferring dedusted gas from the separator into the back pass comprise an opening formed in a side wall of the back pass which is an upper extension of the common wall between the separator and the back pass.

29. The reactor device as claimed in claims 22, wherein the acceleration duct comprises at least a first part connected to said wall of the reactor chamber and a second part connected to said first wall of the upper portion of the separator, said first and second parts forming an angle between them.

30. The reactor device as claimed in claim 29, wherein the acceleration duct further comprises an intermediary part, extending between said first and second parts and forming angles between them.

31. The reactor device as claimed in claim 22, wherein the walls of the reactor chamber and the walls of the separator comprise heat exchange tubes in which a heat transfer medium can pass and in that tubes of the chamber walls are bent so as to extend in the walls of a first portion of said acceleration duct and tubes of the separator wall are bent so as to extend in the walls of a second portion of said duct.

* * * * *